United States Patent [19]

Waddell

[11] 4,310,981

[45] Jan. 19, 1982

[54] SELECTIVE TRIGGER UNIT FOR MULTIPLE BARREL FIREARMS

[75] Inventor: Richard G. Waddell, Gardena, Calif.

[73] Assignee: Eric A. Stern, Aspen, Colo.

[21] Appl. No.: 73,222

[22] Filed: Sep. 7, 1979

[51] Int. Cl.[3] ..... F41C 19/00

[52] U.S. Cl. ..... 42/42 R

[58] Field of Search ..... 42/42 R

[56] References Cited

U.S. PATENT DOCUMENTS

| | | | |
|---|---|---|---|
| 2,052,957 | 9/1936 | Wareham | 42/42 R |
| 3,334,435 | 8/1967 | Tonkin | 42/42 R |
| 3,537,203 | 11/1970 | Weatherby et al. | 42/42 R |
| 3,766,677 | 10/1973 | Waddell | 42/42 R |
| 3,786,588 | 1/1974 | Soana | 42/42 R |

FOREIGN PATENT DOCUMENTS

| | | | |
|---|---|---|---|
| 929235 | 6/1955 | Fed. Rep. of Germany | 42/42 R |

*Primary Examiner*—Charles T. Jordan

*Attorney, Agent, or Firm*—Herzig & Walsh Inc.

[57] ABSTRACT

A double barreled firearm which may be of the over and under configuration. A removable trigger group or unit is releasably secured to the bottom of the receiver. A selector switch or lever is provided forward of the trigger which cooperates with the trigger unit whereby a selection can be made to fire either barrel in response to the first pull of the trigger with the other barrel capable of being fired immediately in response to the second pull of the trigger. The trigger carries a laterally movable transfer block or member which is adjusted by the selector lever. The transfer block or member has pivoted to it the sear actuator block. A hammer pilot spring rod is provided for each hammer and the ends of these pilot rods cooperate with an extension on the sear actuator block. The sear actuator block is moved laterally to one side, or the other, to engage the sear that is selected to be fired in response to the first pull of the trigger. Upon firing of the first barrel, its hammer pilot spring rod is moved to allow the sear actuator to move to a more forward position whereby to engage a secondary shoulder on the other sear so that the other sear is actuated in response to the second pull of the trigger for firing the other barrel. The mechanism is not dependent on movement of an inertia member.

12 Claims, 6 Drawing Figures

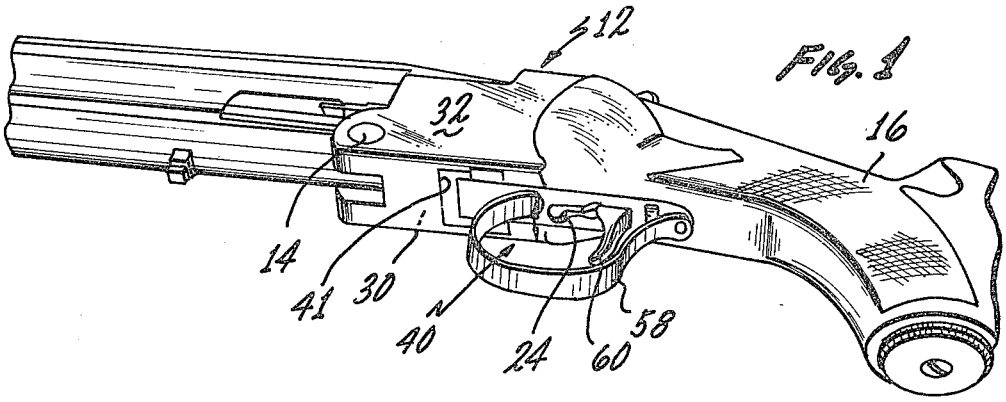
FIG. 1
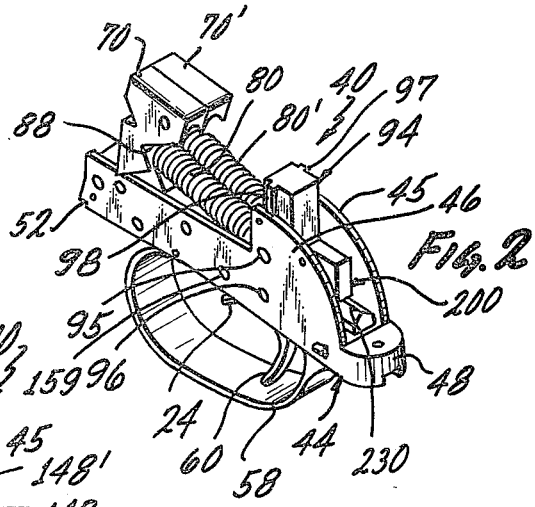
FIG. 2
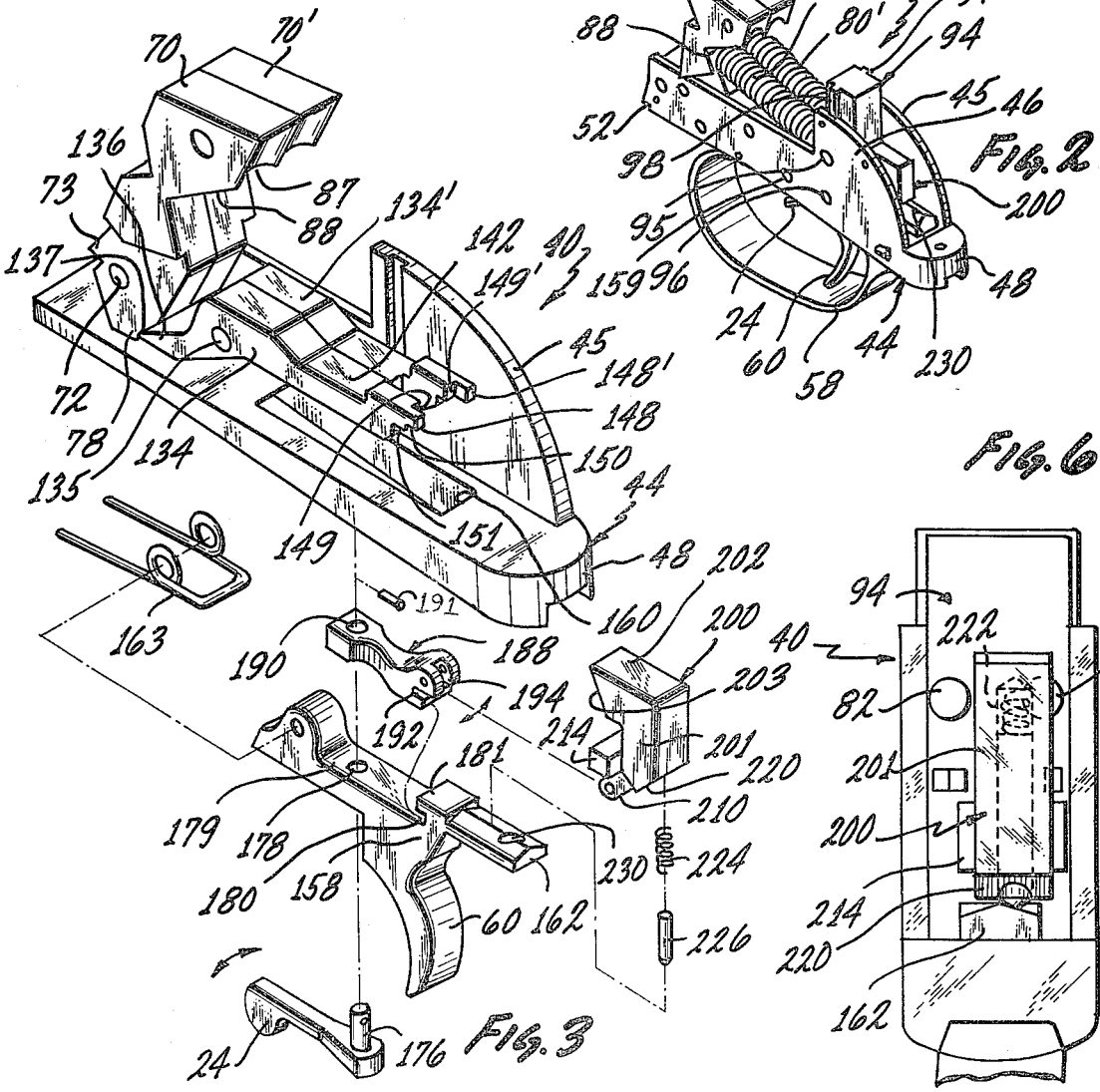
FIG. 3
FIG. 6
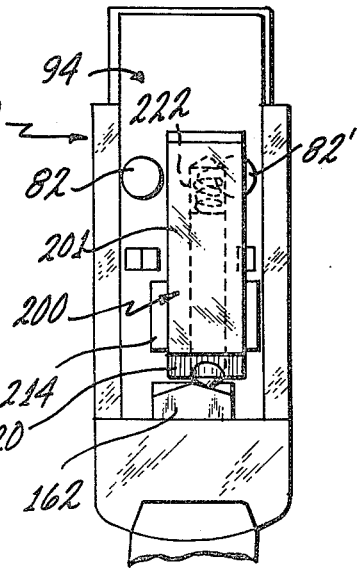

SELECTIVE TRIGGER UNIT FOR MULTIPLE BARREL FIREARMS

BACKGROUND OF THE INVENTION

1. Field of the Invention

The field of the invention is that of firearms and more particularly, double-barreled guns which may be of the over and under configuration. The invention is especially concerned with trigger mechanism and selector means whereby either one of two barrels may be selected to be fired first, that is in response to the first pull of the trigger, while the other barrel is fired in response to a second pull of the trigger. Safety means for preventing firing of either barrel may be provided.

2. Description of the Prior Art

It is considered that the most relevant prior art is U.S. Pat. No. 3,766,677 the herein invention being an improvement in the mechanism of the patent.

U.S. Pat. No. 3,766,677 incorporates a removable trigger group which embodies a selector mechanism having positions wherein either one or two barrels can be selected to be fired, or the mechanism can be placed on safe. The mechanism of the prior patent does not provide a means for making a single setting of the selector button or switch, whereby either of two barrels is selected to be fired in response to a first pull of the trigger with the other barrel being fired in response to a second pull of the trigger. The herein invention provides means to meet this need in the field of firearms as well as providing improvements in the combination and arrangement of parts, whereby the hammers are released for firing as well as other improvements.

It is typical of the prior art that a part such as the actuator block or sear release has to be moved in response to recoil inertia in order to set up conditions for it to be positioned for firing of the second barrel.

In the prior art systems if the first barrel did not fire of course the inertia block did not respond or do anything and thus it was not possible to fire the second barrel. With the prior art systems if the first barrel didn't fire, it not being possible to fire the second barrel, it was necessary to break the gun, that is to open it and reload or reposition the manual selector to the other barrel. The time factor, as between firing the first barrel and the second, might be a fraction of a second, but still this factor could become very important, for example if firing at a flock of birds or for example, if the weapon is being used as a military weapon or a law enforcement weapon, it is desirable to have the capability of firing the second barrel instantly.

SUMMARY OF THE INVENTION

A preferred exemplary form of the invention and best mode of practice of the invention, as presently known, is described in detail hereinafter.

The mechanism includes a removable trigger group positionable within the receiver and responsive to a selector switch or button which is settable to fire either barrel first, as desired, and then the second barrel. The trigger group includes the trigger, hammers, sears, and a transfer block and sear actuator which are carried by the trigger. The hammers are provided with hammer springs and spring pilot rods which are constructed to cooperate with an extension on the sear actuator block whereby the result is achieved, that the selector can be set so that a desired barrel is fired in response to a first pull of the trigger, and the other barrel is fired in response to a second pull of the trigger. The selector can be set so that the first pull of the trigger will fire either barrel.

A lateral adjustment of the transfer block or member and sear actuator block determines which hammer is to be released first, by way of the sear actuator block engaging one or the other of the sears. Upon firing of the barrel selected to be fired first, its hammer pilot spring rod moves forwardly to allow the sear actuator block to move to a more forward position, wherein it can then engage a secondary shoulder on the other sear. In this manner, either barrel can be selected to be fired first and the other barrel will be fired upon the second pull of the trigger.

The arrangement and design of the trigger mechanism embodies a very unique characteristic. The combination does not depend upon inertia movement of the actuator block or any other part to set up conditions for firing of the second barrel. It is typical of the prior art that a part such as the actuator block has to be moved in response to recoil inertia in order to set up conditions for it to be positioned for firing of the second barrel. The herein combination does not depend upon such inerta movement.

In the herein invention a hammer spring pilot rod allows the actuator block to move forward so that it can engage with a more forward shoulder on the other sear so that the mechanism has the capability of immediately firing the other barrel without any delay. This is significant since a delay of any magnitude is a deficiency in that the user may desire to fire the second barrel instantly. In other words the herein combination not being dependent upon an inertia movement after pulling the trigger the first time to fire one barrel, the combination is immediately conditioned for pulling the trigger a second time for firing the second barrel. This is true even though the first barrel does not fire.

A primary object of the invention is to realize the foregoing described capability that after selecting and firing one barrel or the other unselected barrel is immediately ready and capable of being fired.

Another object of the invention is to provide a trigger mechanism and selector lever or element for use in a double barreled firearm, whereby either barrel can be selected to be fired in response to a first pull of the trigger, with the second barrel being fired in response to a second pull of the trigger.

Another object is to realize an improved mechanism as in the foregoing, wherein the trigger assembly includes hammers, sears, hammer spring rods, a trigger, and a transfer block or members and sear actuator block which are carried by the trigger and which are moveable laterally, the sear actuator block having a part positioned to cooperate with ends of the hammer spring pilot rod in a manner whereby the transfer block and sear actuator block can be adjusted laterally, so as to cause actuation of either one or the other of the sears first and such that upon actuation of the first sear, the sear actuator block is moved into a forward position wherein it can engage a secondary shoulder on the other sear for actuating it.

Further objects and advantages of the invention will become apparent from the following detailed description and annexed drawings.

BRIEF DESCRIPTION OF THE DRAWINGS

FIG. 1 is a pictorial partial view of a gun embodying the improved trigger mechanism.

FIG. 2 is an isometric view of the trigger mechanism.

FIG. 3 is an exploded view of the improved trigger mechanism;

FIG. 6 is a rear view of the trigger mechanism of FIGS. 3, 4, and 5.

DESCRIPTION OF THE PREFERRED EMBODIMENT AND BEST MODE OF PRACTICE

Figure 4:
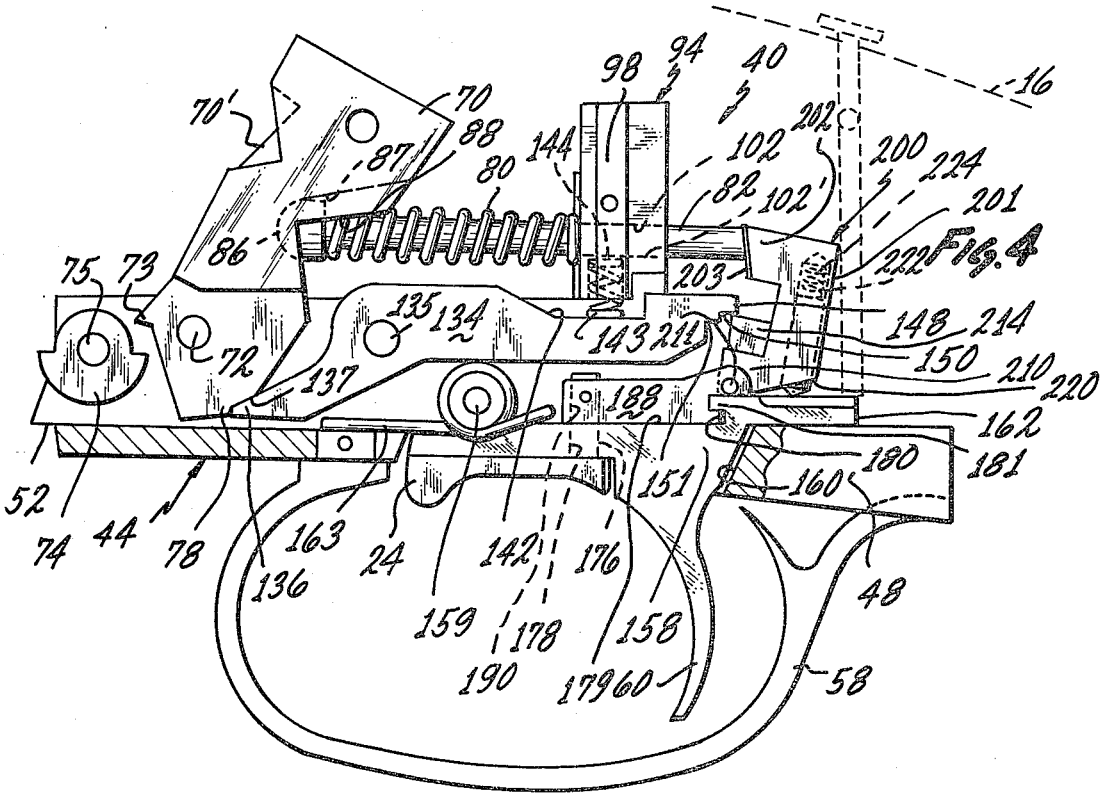
FIG. 4 is an elevational view of the trigger mechanism, with the parts shown in position for firing the left-hand hammer.

The invention is an improvement in the trigger mechanism of U.S. Pat. No. 3,766,677. The trigger mechanism of the invention as described herein, may be embodied in a gun, which is similar to that of the previous patent, the disclosure of which is hereby incorporated herein by reference.

Referring to the drawings, the firearm or gun, which is shown by way of example, is shown as an over and under type, having two barrels, one positioned over the other. The barrels may be rifle barrels of different caliber, or may be shotgun barrels. The gun as shown is of the breakopen type like that of the previous patent referred to. The gun as shown, has a receiver 12, and the gun includes a barrel housing, which is pivotally secured to the receiver 12 by trunnion lugs, such as that shown at 14. The stock 16 is conventional and is secured to the receiver 12 in a known manner. A release lever may be provided which enables the action to be broken, this mechanism being like that of the prior art referred to.

Numeral 24 designates the selector lever, which enables the operator to select a position for firing either of the two barrels as will be described more in detail hereinafter.

The receiver 12 may typically be fabricated from a single piece of metal, such as steel, having a top with side wings 30 and 32, this construction preferrably being like that of the previous patent. The inside of the plates 30 and 32 may be formed to provide channels to receive an insertable breech block, not shown, which may be like that of the prior art patent. The breech block can be pinned in place. The breech block may have firing pins mounted in it in bores that are angular to each other. The firing pins operate against a spring within the breech block; this construction might be like that of the previous patent.

The trigger group or trigger assembly or mechanism is identified as a whole by the numeral 40. The trigger mechanism or unit is removable from the gun by way of a bottom opening 41 in the receiver. The trigger mechanism includes a frame 44 having side plates 45 and 46, having a configuration as shown, which are upstanding from a base member 48. At the front end of the base member is an angular shoulder 52, which can hook over a ledge at the bottom of the channel or way in the receiver in which the breech block is received and then the trigger unit can be latched in position in the receiver, by way of a spring latch. Carried by the frame 44 is trigger guard 58, the trigger being designated by the numeral 60.

The improvement of the invention resides primarily in the trigger mechanism and the selector means. This mechanism is shown more in detail in FIGS. 3–6, which are in part schematic, FIG. 3 being an exploded view, to clearly illustrate the relationship of the parts. The trigger mechanism is a self-contained subassembly, which is controlled in part by the selector switch as will be described. The assembly carries the hammers, the hammer springs and the hammer spring guide or pilor rods, which cooperate with the actuator block or sear release to initially fire the barrel selected and to subsequently fire the remaining barrel with a second pull of the trigger, as will be described. The hammer spring rods cooperate to accurately position the actuator block or sear release to permit only the firing of one barrel at a time with each pull of the trigger.

The hammers are designated at 70 and 70′, the hammers being pivotally mounted on a shaft 72, extending between the sides 44 and 45 of the frame 44. The hammers have a configuration, as shown in the Fig., adapting them to come into a striking relationship with the firing pins, as previously described. The hammer 70 has an extending toe 73, which can cooperate with the cam 74 on a shaft 75, the cam having two diametrically opposed radial shoulders, as shown. The cam can be actuated by a cocking lever, not shown, for cocking the hammers. The hammer 70 also has a downwardly extending toe 78, below pivot 72, having a purpose which will be referred to again presently. The two hammers are alike, so that both need not be described in detail.

Numerals 80 and 80′ designate a pair of hammer springs. The hammer springs are around the hammer spring rods or pilot rods as designated at 82 and 82′. At the end of the hammer spring pilot rod 82 there is provided a rounded member 86, which is received in a slot of arcuate configuration, as designated at 87, which is formed in a slanting surface 88, at the rear of the hammer 70. The other hammer spring pilot rod similarly engages the other hammer 70′.

Numeral 94 designates a spring guide block, which is secured between the sides wings, at the rear of the side plates 45 and 46 of the trigger unit, by way of a transverse pin as designated at 95 and 96 in FIG. 2. The block 94 is rectangular in cross-section, having side ribs, as shown at 97 and 98, which are received in channels in side wings 45 and 46, as may be seen in FIG. 2. It has two parallel bores in it as designated at 102 and 102′ and the ends of the hammer spring pilot rods 82 and 82′ extend through these bores, as may be seen illustratively in FIGS. 4 and 5.

Figure 5:
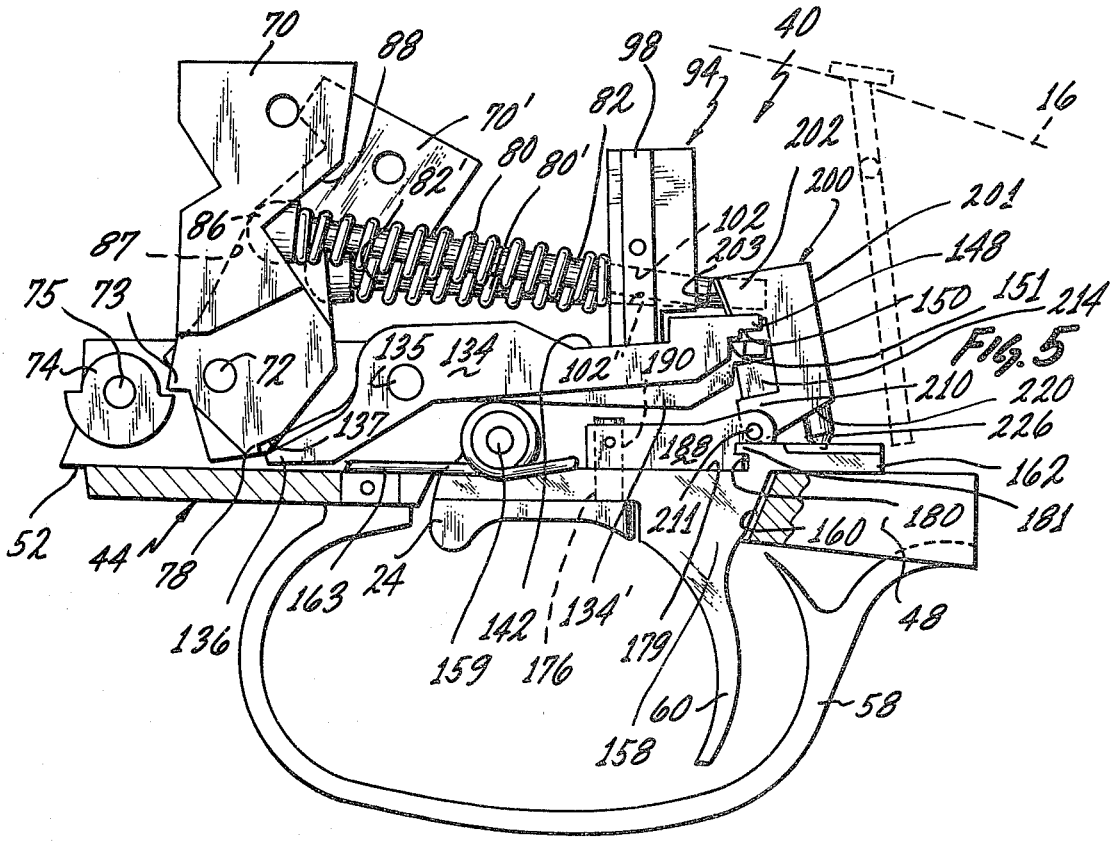
FIG. 5 is a view similar to that of FIG. 4 with the parts in position after a first pull of the trigger, and ready for second pull.

The sears are identified by the numerals 134 and 134′. The sears are carried on a transverse shaft 135 extending between the sides 45 and 46 of the frame 44. The sears have a shape as shown in FIGS. 3, 4, and 5. The sear 134 has a forwardly extending part, the end of which forms a toe 136 which cooperates with a notch 137, formed in the lower end part of the hammer 70. Counterclockwise movement of the sear 134 will release the hammer 70 to a firing position.

At the rear end of the sear 134, it has a configuration, as may be seen in FIG. 3, including an indentation formed in its upper surface, as shown at 142. See FIG. 3. Engaged against the surface is a sear spring 143, which is seated in a bore 144 formed in the spring guide block 94. The spring biases the sear toward engagement with the hammer 70.

At the rear end of the sear 134, it has an extending finger 148, on the inside of which is a square shoulder 149, and underneath the finger 148 there are two square shoulders, as shwon at 150 and 151, which will be referred to again presently. See FIG. 3 and FIG. 4.

The sear 134' is in all respects, like the sear 134, and therefore it need not be described in detail. This is true also of hammer 70' and its hammer spring and pilot rod.

The trigger 60 has an upper part as designated at 158 and it is pivotally mounted on a transverse pin 159. See FIG. 3. The upper part 158 of the trigger 60 extends through an opening 160 in the base 48 of the trigger unit or mechanism. At the rear of the trigger is an extending platform part 162 having a shape as shown which will be referred to again presently.

Numeral 163 designates the trigger biasing spring. It is U-shaped as shown having two loops that engage pin 159.

The parts of the selector mechanism are shown in the exploded view, FIG. 3 and in assembled relationship in FIGS. 4 and 5. The selector lever is designated by the numeral 24 and is positioned just forward of the trigger 60 for easy access by the user to select either one barrel or the other to be fired first. The lever 24 has a pin 176 which extends upwardly through an aperture 178 formed in the upper flat surface 179 of the trigger 60. At the rear of the flat surface 179 of the trigger is a slot 180 with part 181 overhanging this slot, as may be seen in FIG. 3.

Numeral 188 designates the selector transfer member or lever. At one end it has a bore 190 which is received on the pin 176 so that is can be moved angularly by the lever 24 being held by pin 191. At the other end, the member 188 has transverse slot 192 as shown, and it has longitudinal slot 194. The part of member 188 below the transverse slot 192 is received in the slot 180 in the top of the trigger as previosly described. The member 188 has pivotal attachment to the actuator block or sear release as will be described. The sear release or actuator block is identified by the numeral 200. The configuration of the actuator block or sear release can be observed from FIGS. 3, 4 and 5 and also FIG. 6 which is a rear view of the trigger assembly. The actuator block or sear release is of angular shape as may be seen in FIG. 3, having an upright part 201 and a forwardly extending part 202, the front surface of which is beveled as shown at 203.

The transfer block 200 has a downwardly extending arm 210, having an aperture in it and it is pivoted to the end of member 188 in the longitudinal slot 194 and by way of a pin 211. The actuator block has a forward rectilinear configuration as designated at 214, the purpose of which will be described presently. The bottom of the upright part 201 of the block 200 is beveled as shown at 220. The upright part has a bore in it as designated at 222 which then receives a spring 224 and a pin 226, the end of which is pointed and which is received in a receptacle opening 230 in the end part 162 of the trigger 60. Thus as may be seen the spring 224 normally urges the actuator block 200 in a counter-clockwise direction. These parts are shown in greater detail in FIG. 6.

FIGS. 4 and 5 illustrate working positions of the actuator block 200 and how its front face 203 cooperates with the ends of the hammer spring pilot rods 82 and 82'.

Safety means may be provided of a type which cooperate with the end part 162 of the trigger to place the firearm on safety, that is in such a position that it cannot be fired. Various known types of safety means may be used as illustrated in broken lines in FIGS. 4 and 5.

OPERATION OF THE TRIGGER MECHANISM

From the foregoing, it will be understood that the selector lever 24 can be shifted to the left or to the right from the central position, so as to select either one barrel or the other to fire first.

In the Figs., the right hand position of lever 24 is the position for firing the upper or over barrel which is fired by way of the left hand hammer 70. The left hand position of lever 24 is the position for firing the other (under) barrel, by way of the right hand hammer 70'.

FIG. 4 shows the parts with both hammers cocked. The lever 24 has been shifted to the right for firing the under barrel, that is for releasing the left hand hammer 70. The transfer lever 188 and the actuator block 200 have been shifted to the left so that the face 203 of the extension 202 of the transfer block 200 is engaged by the pilot stem 82 of hammer 70. The ledge or corner of part 214 on the actuator block 200 is underneath the extending projection or finger 148 on sear 134. If the trigger 60 is now pulled and moves in a counter-clockwise direction around its pivot pin 159 and its rear end 162 rises, the transfer lever 188 and the actuator block 200 are lifted with the trigger so that the ledge or shoulder 214 on the actuator block 200 lifts the projection or finger 148 of sear 134 rotating it in a counter-clockwise direction so that its toe 136 disengages from notch 137 of hammer 70 releasing the hammer causing the under barrel to be fired.

FIG. 5 shows the parts in the position that they are in immediately after firing the first barrel. The pilot rod 82 has moved forward, as shown, so that it does not engage the extension 202 on the actuator block 200 which has moved in a counter-clockwise direction around its pivot 211. It is now in a position wherein the shoulder or ledge 214 of the actuator block 200 is now engaged under the auxilary shoulder 151 on the right hand sear 134', the shoulder being farther forward than the finger 148'. Upon a second pull of the trigger, it again moves in a counter-clockwise direction, lifting the transfer lever 188 and the actuator block 200 as before, the ledge 214 on the actuator block 200 by reason of its engagement with the shoulder 151 now lifting the sear 134' and rotating it in a counter-clockwise direction so that it disengages from the hammer 70' causing the other barrel to now be fired.

From the foregoing, it will readily be understood that the one barrel, that is the under barrel, having been selected to be fired first, the sequence of events as described would be similar for the second barrel. Before firing the first barrel, its hammer is holding the actuator block in a rearward position. Actual release of the hammer permits the actuator block to move forward, allowing firing of the second barrel.

It is to be noted in FIG. 5 that the spring guide or pilot rod 82', not being in contact with the extension 203 on the actuator block 200, has permitted the actuator block to pivot forwardly into the position shown in FIG. 5, with ledge 214 under shoulder 151.

From the foregoing, those skilled in the art will readily recognize that the mechanism as described achieves and realizes all of the objectives set forth in the foregoing. It effectively makes possible the purpose of selecting either one barrel, or the other, to be fired first. After firing the first barrel, the second barrel is immediately capable of being fired. The mechanism is of an effective design providing the appropriate degree of reliability and freedom from lack of safety arising either from unexpected manipulation of parts, or otherwise.

As may be seen, the mechanism as described provides for selecting one barrel, or the other, to be fired first. In a non-selective, modified arrangement, where no manual switching is desired, the selector lever and its associated parts could be removed and the actuator block 200 would be permanently positioned in either a right or left hand position, by means of a fastening member such as a pin or screw or by permanent attachment of the actuator block 200 to the trigger 60. Single barrel firing order would be achieved, but would not be selected manually.

The foregoing disclosure is representative of a preferred form or forms of the invention and is to be interpreted in an illustrative, rather than a limiting sense. The invention to be accorded the full scope of the claims appended hereto.

I claim:

1. In a multi-barrel firearm, in combination, individual hammers and sears associated with each barrel, trigger means for actuating the sears individually, sear release means positioned to be actuatable by the trigger means for actuating either one of the individual sears, said sear release means being mounted to be positionable to actuate a second sear after a first has been actuated, and means related to the sear release means whereby upon actuation of the first sear, the said sear release means is moved whereby to actuate the second sear upon a further pull of the trigger, said related means being constructed to be independent of recoil and counter-recoil of the firearm.

2. A firearm as in claim 1, including two sears positioned relatively adjacently, and means whereby upon actuation of one sear the said sear release means is moved forwardly into position for actuating the second sear.

3. A firearm as in claim 2, having means whereby actuation of either of two hammers produces a movement of the sear release member to bring it into engagement for actuating a second sear.

4. A firearm as in claim 3, wherein the said means for producing movement of the sear release means for actuating the second sear comprises a hammer pilot rod positioned to have engagement with the sear release means whereby to allow the sear release to moveforward upon actuation of the hammer.

5. A firearm as in claim 1, wherein the sear release means is mounted for lateral movement and manual selector means for moving the sear release means laterally.

6. A firearm as in claim 1, including a biasing means whereby the sear release means is normally biased in a direction towards the said sears.

7. In a multi-barrel firearm, in combination, hammers and sears associated with each barrel, trigger means for actuating the sears individually, sear release means positioned to be actuatable by the trigger means for actuating either one of the individual sears, said sear release means being mounted to move laterally to actuate one sear or the other, said sear release means being pivotally mounted and means related to the sear release means whereby upon actuation of the first sear the sear release means is moved pivotally whereby to engage a second sear for actuating it in response to a further pull of the trigger, the said sear release means being constructed to be independent of recoil or counter-recoil of the firearm.

8. A firearm as in claim 7 including means actuatable by the hammers engageable with the sear release means whereby upon actuation of a hammer, the sear release means is moved in a direction to engage a sear that has not yet been actuated.

9. A firearm as in claim 8, wherein the sears are provided with shoulder means actuatable by the sear release means, each sear having a rearwardly positioned shoulder means positioned to be actuated by the sear release means after the sear release means has been allowed to be moved pivotally by actuation of a hammer.

10. A firearm as in claim 7, including barrel selector means, said barrel selector means including a manually actuatable lever positioned adjacent to the trigger means, and means whereby the said lever can move the said sear release means to select a barrel.

11. A firearm, as in claim 12, wherein the trigger means includes a trigger member, a transfer member connected to the said manually actuatable lever, the said sear release means including an actuator member having pivotal attachment to the transfer lever.

12. A firearm, as in claim 11, wherein the said transfer lever and sear release means are mounted over the trigger member, and means normally biasing the sear release means towards the sears.

* * * * *